US006179228B1

(12) United States Patent
Ramaker et al.

(10) Patent No.: US 6,179,228 B1
(45) Date of Patent: Jan. 30, 2001

(54) WATER FOUNTAIN SPRAY MODIFIER

(75) Inventors: Dennis L. Ramaker, Valders; David E. Wasmer, Kiel, both of WI (US)

(73) Assignee: Aquamaster, Kiel, WI (US)

( * ) Notice: Under 35 U.S.C. 154(b), the term of this patent shall be extended for 0 days.

(21) Appl. No.: 09/347,764

(22) Filed: Jul. 6, 1999

(51) Int. Cl.[7] ..... B05B 1/26

(52) U.S. Cl. ..... 239/518; 239/17; 239/503; 239/505; 239/507; 239/512; 261/90; 261/120

(58) Field of Search ..... 239/17, 22, 23, 239/502, 503, 505, 507, 508, 512, 518; 261/91, 120

(56) References Cited

U.S. PATENT DOCUMENTS

| | | | | |
|---|---|---|---|---|
| 481,082 | | 8/1892 | Umholtz . | |
| 603,487 | * | 5/1898 | ODonnell | 239/508 |
| 658,155 | * | 9/1900 | Mathen | 239/508 |
| 1,299,958 | * | 4/1919 | Kermack et al. | 239/512 |
| 1,751,345 | * | 3/1930 | Matsui | 239/508 X |
| 2,451,071 | | 10/1948 | Cline | 299/121 |
| 2,468,137 | | 10/1949 | Evans | 158/75 |
| 2,701,165 | * | 2/1955 | Bete et al. | 239/508 |
| 2,747,930 | * | 5/1956 | Hyde | 239/508 X |
| 2,943,444 | | 7/1960 | Baxter | 60/35.54 |
| 3,465,968 | * | 9/1969 | Halpern | 239/512 X |
| 4,310,122 | | 1/1982 | Vikre | 239/502 |
| 4,569,485 | | 2/1986 | Walto | 239/456 |

* cited by examiner

*Primary Examiner*—Andres Kashnikow
*Assistant Examiner*—Robin O. Evans
(74) *Attorney, Agent, or Firm*—Andrus, Sceales, Starke & Sawall, LLP

(57) ABSTRACT

A water fountain spray modifier for use in combination with a pond aerator to modify the water fountain spray pattern generated by the pond aerator. The water fountain spray modifier includes a support arm pivotally mounted between a pair of brackets mounted to the pond aerator. The support arm includes a spray diffuser formed on its first end and is movable between an operative position and an inoperative position. When the support arm is in the operative position, the spray diffuser is generally aligned with the outlet opening of the pond aerator such that the spray diffuser reduces the height of the water fountain produced by the pond aerator. The water fountain spray modifier includes a locking mechanism that secures the support arm and attached spray diffuser in either the operative position or the inoperative position. The locking mechanism includes a plunger movable between a retracted position and an extended position. A bias force exertion member is coupled to the plunger and exerts a bias force on the plunger to urge the plunger into its extended position. The bias force exertion member can be operated to move the plunger into the retracted position against the bias force. The bias force exertion member can be either a bias spring surrounding the plunger or an electric solenoid operable to move the plunger between its retracted and extended positions.

27 Claims, 2 Drawing Sheets

FIG. 1
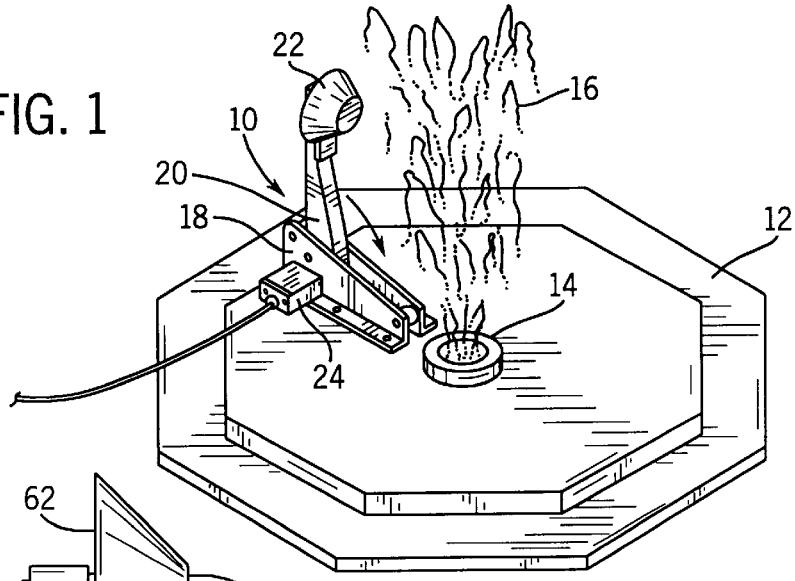
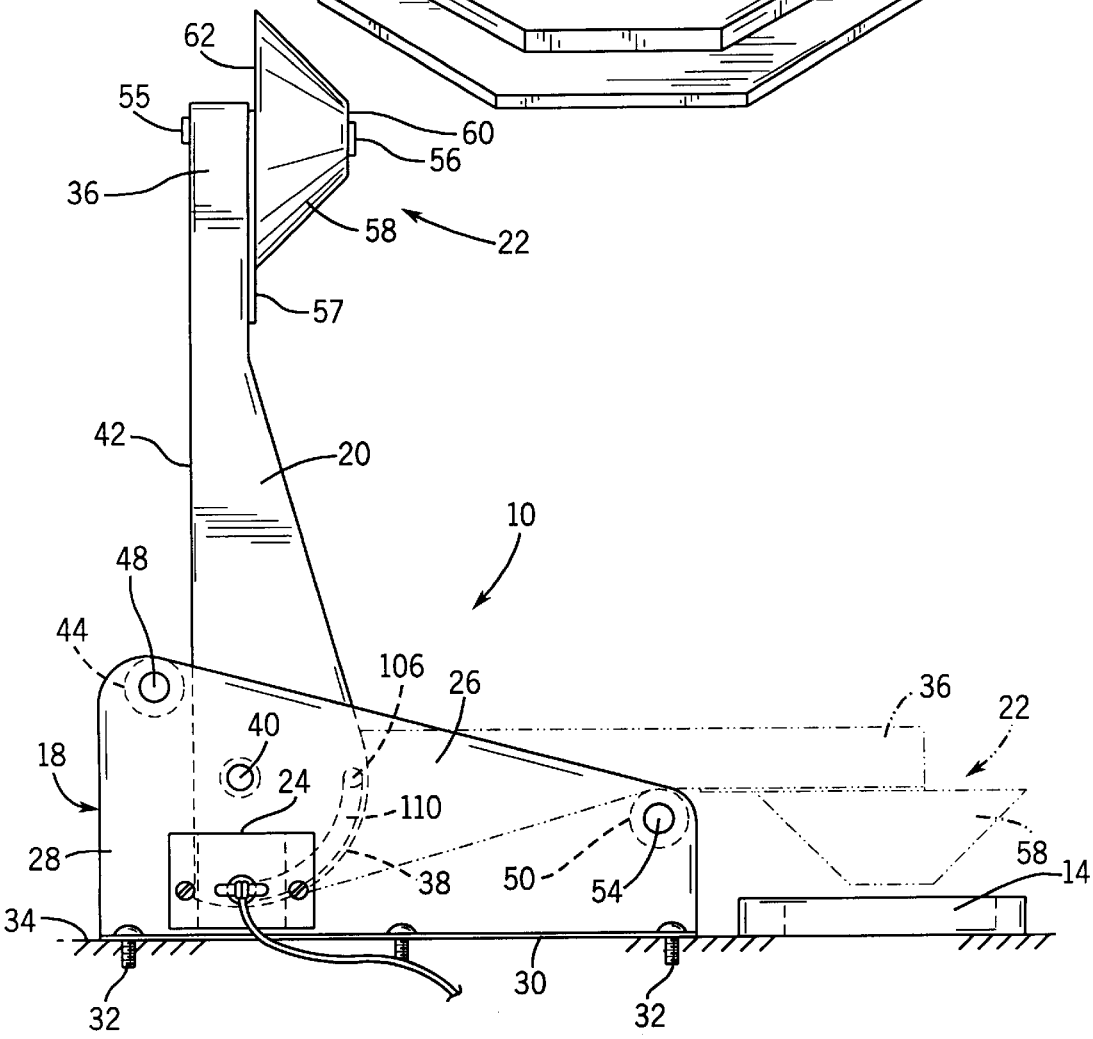
FIG. 2

FIG. 3
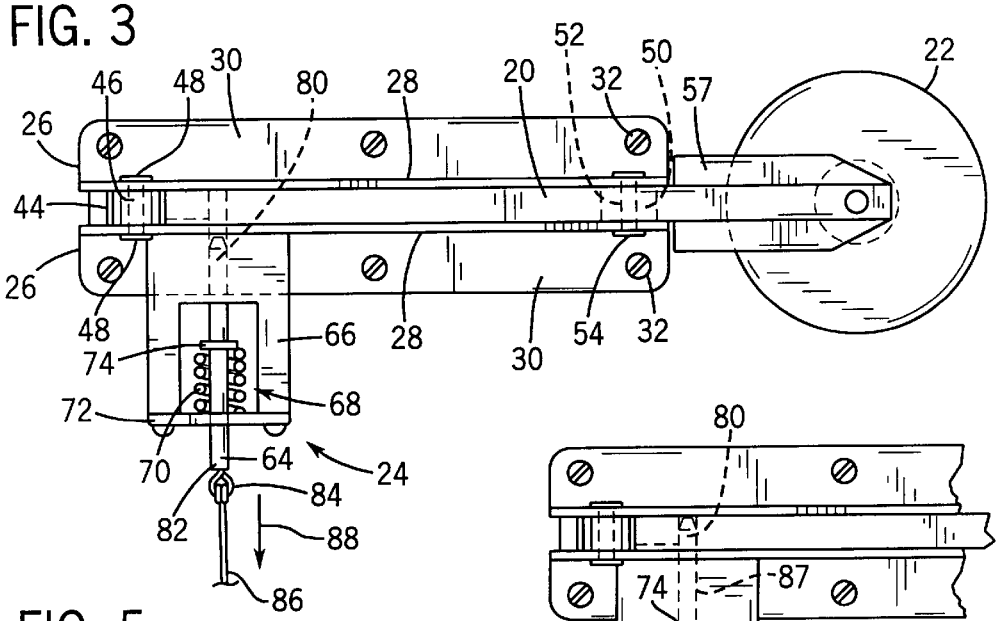
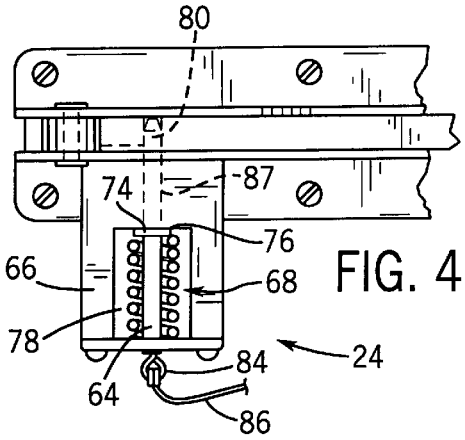
FIG. 4
FIG. 5
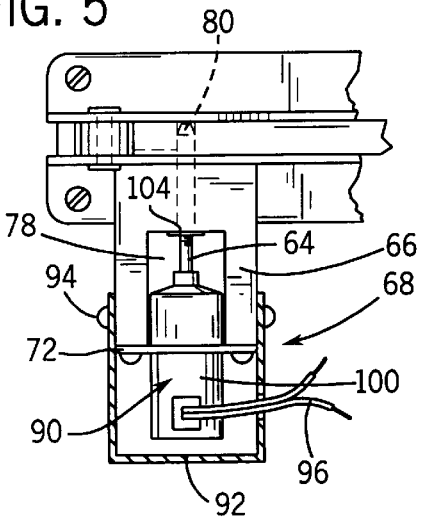
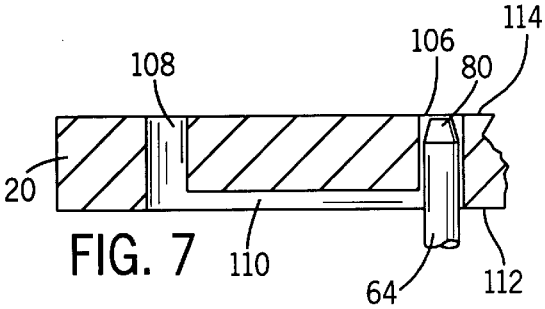
FIG. 7
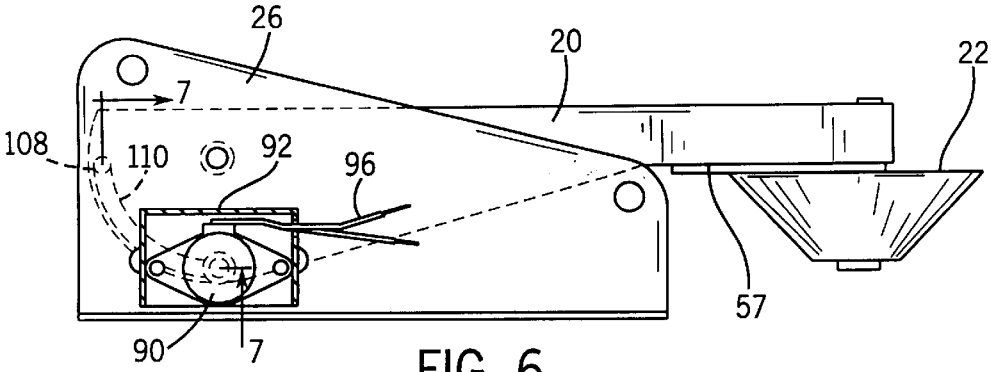
FIG. 6

WATER FOUNTAIN SPRAY MODIFIER

BACKGROUND OF THE INVENTION

The present invention generally relates to a pond aerator. More specifically, the present invention relates to a spray modifier that can be used to vary the spray pattern of the pond aerator.

Pond aerators typically include an underwater pump assembly that draws cool water from the bottom of the pond and directs the water upward through a pipe to an outlet opening contained in a float positioned at the surface of the pond. The water from the under water pump exits the outlet opening positioned in the float and forms a water fountain that aerates the water to aid in the prevention of algae growth within the pond. The spray pattern of the fountain typically extends several feet above the water surface in order to aid in the aeration of the pond water.

Although the spray pattern from a conventional pond aerator sufficiently aerates the pond water for most applications, specific problems may arise when the pond aerator is utilized in a retention pond including hazardous materials, such as radioactive or hazardous waste water retention ponds. Although these types of ponds require pond aerators to prevent the growth of algae, high wind conditions may blow the fine droplets of water into undesirable locations. For example, if the pond aerator is positioned close enough to the shore of the pond, it is possible that very high winds could carry the hazardous pond water from the water fountain onto the banks of the pond and possibly further from the pond aerator. Currently, when high wind conditions occur, the owner of the pond must turn off the pond aerator to prevent the pond water containing the hazardous material from leaving the boundaries of the retention pond.

Therefore, it is an object of the present invention to provide a spray modifier that can be operated to adjust the spray pattern of the water fountain from a pond aerator during high wind conditions or when otherwise desired by the user. It is a further object of the present invention to provide a spray modifier that can be moved from an inoperative position to an operative position from the shore of the pond. Further, it is an object of the present invention to provide a spray modifier that includes a spray diffuser that can be positioned slightly above the outlet opening of the pond aerator to reduce the overall height of the water fountain produced by the pond aerator.

It is an additional object of the present invention to provide a spray modifier that includes a locking mechanism that securely retains the support arm and spray diffuser in either the operative or inoperative position to prevent inadvertent movement of the support arm between the two positions. Additionally, it is an object of the present invention to provide a locking mechanism that includes a plunger movable between a retracted position and an extended position such that when the plunger is in the extended position, the plunger is received within a locking hole to securely retain the support arm and spray diffuser in the desired position. It is an additional object of the present invention to provide a locking mechanism that includes an electric solenoid that can be remotely operated from the shore of the pond to permit the support arm and spray diffuser to move between the operative and inoperative positions.

SUMMARY OF THE INVENTION

The present invention is a spray modifier to be mounted adjacent to the outlet opening of a pond aerator such that the spray modifier can be activated to modify the spray pattern of the pond aerator. The spray modifier of the present invention includes a support arm that is pivotally mounted between a pair of spaced mounting brackets. The support arm extends between a first end and a second end and is movable between a vertical, inoperative position and a horizontal, operative position.

A spray diffuser is securely mounted to the first end of the support arm. In the preferred embodiment of the invention, the spray diffuser has a frustoconical shape. When the support arm and attached spray diffuser are moved to the operative position, the spray diffuser is aligned with and positioned slightly above the outlet opening of the pond aerator. When the spray diffuser is in the operative position, the frustoconical shape of the spray diffuser deflects the spray of water leaving the pond aerator to reduce the overall height of the water fountain.

The spray modifier further includes a locking mechanism that is attached to one of the spaced mounting brackets and positioned adjacent to the support arm. The locking mechanism includes a plunger movable between a retracted position and an extended position. When the plunger is in the retracted position, the plunger is received within either a first locking hole or a second locking hole contained in the second end of the support arm. The first and second locking holes formed in the second end of the support arm are spaced from each other and are joined by arcuate plunger groove. The plunger groove is recessed from a face surface of the support arm and allows the plunger to move between the first and second locking holes.

When the support arm is in the inoperative position, the extended plunger of the locking mechanism is received within the second locking hole to positively retain the support arm in the inoperative position. When the support arm is in the operative position, the extended plunger of the locking mechanism is received within the first locking hole to positively retain the support arm in the operative position.

The locking mechanism includes a bias force exertion member that exerts a bias force on the plunger to urge the plunger to its extended position. In the first embodiment of the invention, the bias force exertion member is a bias spring positioned surrounding the plunger that exerts a bias force to urge the plunger into its extended position. A pull cord is attached to the plunger so that an outward force can be applied to the plunger to overcome the bias force and move the plunger into its retracted position.

In the second embodiment of the invention, the bias force exertion member includes an electrically operated solenoid. When the solenoid is de-energized, the solenoid urges the plunger out of the solenoid body to the extended position. When electric power is applied to the solenoid, the solenoid pulls the plunger into the solenoid body to move the plunger into its retracted position.

The locking mechanism in both the first and second embodiments allows the spray arm and the attached spray diffuser to move between the operative and inoperative positions only when the plunger of the locking mechanism is in the retracted position. In this manner, the locking mechanism is able to secure the support arm and spray diffuser in both the operative position and the inoperative position at all times other than when the locking mechanism is activated to move the plunger to its retracted position.

Various other features, objects and advantages of the invention will be made apparent from the following description taken together with the drawings.

BRIEF DESCRIPTION OF THE DRAWINGS

The drawings illustrate the best mode presently contemplated of carrying out the invention.

In the drawings:

FIG. 1 is a perspective view of a water fountain spray modifier of the present invention shown as mounted to a float for a pond aerator;

FIG. 2 is a side view of the water fountain spray modifier of the present invention shown in its inoperative position and shown in phantom in its operative position;

FIG. 3 is a top view of the water fountain spray modifier illustrating the spring-biased plunger of the locking mechanism in its retracted position;

FIG. 4 is a partial top view illustrating the plunger of the locking mechanism in its extended position;

FIG. 5 is a partial top view illustrating an alternate embodiment of the invention incorporating an electric solenoid in the locking mechanism;

FIG. 6 is a side view of the second embodiment of the invention including the electric solenoid; and FIG. 7 is a partial section view taken along line 7—7 of FIG. 6 illustrating the arcuate groove formed between the pair of locking holes formed on the support arm.

DETAILED DESCRIPTION OF THE DRAWINGS

A spray modifier 10 of the present invention is shown in FIG. 1 as mounted to a float 12 of a conventional pond aerator. Float 12 of the pond aerator is positioned at the water level of the pond and includes an outlet opening 14 through which a fountain of water 16 is pumped from an under water pump (not shown). The under water pump of the pond aerator pumps cool, aerated water from the bottom of the pond, or other body of water, up through the outlet opening 14 to create the water fountain 16. The water forming the fountain 16 is further aerated as it falls back to the pond surface to aid in the prevention of algae growth in the pond. In the preferred embodiment of the invention, the water fountain 16 leaving the outlet opening 14 has a standard shape with an overall height of approximately 8–15 feet above the float 12.

Referring now to FIGS. 1 and 2, the spray modifier 10 includes a base 18, a support arm 20, a spray diffuser 22 and a locking mechanism 24. As can be understood in FIG. 2, the support arm 20 and spray diffuser 22 of the spray modifier 10 are movable between a vertical, inoperative position, shown by the solid lines of FIG. 2, and a horizontal, operative position shown in phantom in FIG. 2. The base 18 is positioned adjacent to the outlet opening 14 such that when the spray modifier 10 is in the operative position, the spray diffuser 22 is generally aligned with and positioned slightly above the outlet opening 14. Thus, when the spray diffuser 22 is in the operative position, the water leaving the outlet opening 14 contacts the spray diffuser 22 such that the spray diffuser 22 reduces the overall height of the water fountain 16 and broadens its spray pattern, as will be discussed in greater detail below.

Referring now to FIGS. 2 and 3, base 18 includes a pair of spaced mounting brackets 26 that each include a vertical plate 28 and a perpendicular, horizontal attachment flange 30. In the preferred embodiment of the invention, each of the mounting brackets 26 is formed from a single piece of stainless steel or aluminum including a 90° bend to define the vertical plate 28 and the attachment flange 30. Each attachment flange 30 includes a plurality of openings that receive a connector 32, such as a screw, to affix the mounting bracket 26 to an upper face surface 34 of the float 12. As previously discussed, the base is mounted to the upper face surface 34 such that the spray diffuser 22 is aligned with the outlet opening 14 when in the operative position.

As can be understood in FIGS. 2 and 3, the mounting brackets 26 are spaced an amount slightly greater than the width of the support arm 20 such that the support arm 20 can pass between the vertical plates 28 of the mounting brackets 26. The support arm 20 has an overall longitudinal length that extends between a first end 36 and a second end 38. As can best be seen in FIG. 2, the second end 38 of the support arm 20 has a generally arcuate shape that allows the support arm 20 to pivot about a pivot pin 40 without contacting the upper face surface 34. Pivot pin 40 passes through the support arm 20 and the vertical plate 28 of each mounting bracket 26. The pivot pin 40 provides a pivot point for the support arm 20 to pivot between the horizontal, operative position and the vertical, inoperative position.

When the support arm 20 is in the inoperative position, as shown in FIGS. 1 and 2, the top edge surface 42 of the support arm 20 contacts an upper rubber stopper 44 that is supported between the vertical plates 28 of the mounting brackets 26 by a pin 46 having a pair of expanded ends 48, as best seen in FIG. 3. The upper rubber stopper 44 provides a positive stop for the counter-clockwise rotation of the support arm 20 as viewed in FIG. 2. Likewise, a lower rubber stopper 50 is mounted between the vertical plates 28 by a pin 52 having a pair of expanded ends 54. The lower rubber stopper 50 provides a positive stop for the support arm 20 to limit the clockwise rotation of the support arm 20 as viewed in FIG. 2.

The spray diffuser 22 is securely attached to first end 36 of the support arm 20 by an attachment bolt having a first end 55 that contacts the top edge surface 42 and a second end 56 that contacts the spray diffuser 22. Preferably, a spray guard 57 is positioned between spray diffuser 22 and the support arm 20.

In the preferred embodiment of the invention shown, the spray diffuser 22 has a frustoconical shape that includes an inclined spray surface 58 extending between a bottom end 60 and a top end 62 of the spray diffuser 22. The angle of the spray surface 58 between the bottom end 60 and the top end 62 determines the spray pattern for the water fountain 16 when the spray diffuser 22 is in the operative position above the outlet opening 14, as shown in phantom in FIG. 2. Although the spray diffuser 22 is shown having a frustoconical shape, it is contemplated that other shapes could be utilized depending upon the desired shape for the water fountain 16.

When the support arm 20 is positioned in the horizontal, operative position such that the spray diffuser 22 is positioned above the outlet opening 14, as shown in phantom in FIG. 2, the water leaving the outlet opening 14 contacts the spray surface 58. The shape of the spray surface 58 deflects the water to create a broader and shorter water fountain 16 as compared to the standard water fountain created by the pond aerator when the support arm 20 and spray diffuser 22 are in the vertical, inoperative position. In this manner, the spray modifier 10 of the invention reduces the overall height of the water fountain 16 when the spray diffuser 22 and support arm 20 are in the operative position. In the preferred embodiment of the invention, the height of the water fountain 16 is reduced to approximately 3–4 feet when the spray diffuser 22 is in the operative position.

Referring now to FIGS. 2–4, in the first embodiment of the invention, the locking mechanism 24 generally includes a plunger 64 that is movable within a mounting block 66 between a retracted position (FIG. 3) and an extended position (FIG. 4). The mounting block 66 is securely attached to the vertical plate 28 of one of the mounting brackets 26. The locking mechanism 24 further includes a bias force exertion member 68 that exerts an inward bias force on the plunger 64 to urge the plunger 64 into the extended position shown in FIG. 4. In the first embodiment of the invention shown in FIGS. 3 and 4, the bias force exertion member 68 is a conventional coil spring 70 that is positioned around the generally cylindrical body of the plunger 64 and is trapped between a face plate 72 attached to the mounting block 66 and a flange 74 securely attached to the plunger body. As shown in FIG. 4, when the plunger 64 is in the extended position, the flange 74 contacts an inner sidewall 76 of an open interior 78 formed by the mounting block 66.

The plunger 64 generally extends between a locking end 80 and an engagement end 82. The engagement end 82 includes a hook 84 through which a pull cord 86 is secured. When the plunger is in the extended position, FIG. 4, the locking end 80 extends into the space between the mounting brackets 26 through a bore 87 formed in the mounting block 66 and an aligned opening formed in the vertical plate 28 of the mounting bracket 26.

In the first embodiment of the invention shown in FIGS. 3 and 4, the plunger 64 can be moved from the extended position shown in FIG. 4 to the retracted position shown in FIG. 3 by applying an outward force to the pull cord 86, as illustrated by arrow 88 in FIG. 3. The pull cord 86 has a length sufficient to reach the banks of the pond such that the user can supply the outward force to the plunger 64 from the shore of the pond. The outward force applied to the pull cord 86 must be sufficient to overcome the inward bias force exerted by the coil spring 70 in order to move the plunger 64 to the retracted position. When the outward force applied to the pull cord 86 is released, the coil spring 70 again urges the plunger 64 back into its extended position as illustrated in FIG. 4.

Referring now to FIGS. 5 and 6, in the second embodiment of the invention, the bias force exertion member 68 is an electrically operated solenoid 90. The solenoid 90 extends through the face plate 72 and is partially contained within the open interior 78 defined by the mounting block 66. A protective solenoid cover 92 is attached to the sidewalls of the mounting block 66 by a pair of connectors 94 such that the entire solenoid 90 is generally shielded. The solenoid 90 includes a pair of lead wires 96 that are connected to a supply of electricity to operate the solenoid 90.

Solenoid 90 is connected to the plunger 64 that can be extended into and out of the solenoid body 100. The plunger 64 terminates at the locking end 80 that is substantially similar to the locking end 80 of the first embodiment shown in FIGS. 3 and 4. In FIG. 5, the solenoid 90 is shown in its de-energized state in which the plunger 64 is in the extended position. When electricity is applied to the solenoid 90 through the lead wires 96, the solenoid 90 pulls the plunger 64 into the solenoid body 100 until flange 104 contacts the solenoid body. After the supply of electricity to the solenoid 90 is removed, the internal configuration of the solenoid 90 forces the plunger 64 outward into its extended position. No further electric power is required to hold the plunger 64 in the extended position, which keeps the power consumption of the solenoid 90 low, since the plunger 64 is almost always in the extended position. In this manner, the solenoid 90 can be energized and de-energized to move the plunger 98 between a retracted position and an extended position.

Referring now to FIGS. 2, 6 and 7, the second end 38 of the support arm 20 includes a first locking hole 106 and a second locking hole 108 joined by an arcuate plunger groove 110. Both the first locking hole 106 and the second locking hole 108 extend completely through the body of the support arm 20 from a first face surface 112 to a second face surface 114. The arcuate plunger groove 110 generally follows the outer, arcuate contour of second end 38 of the support arm 20 and is recessed from first face surface 112. The arcuate plunger groove 110 provides a passageway between the first locking hole 106 and the second locking hole 108 for the plunger 64 as the support arm 20 moves between the operative and inoperative positions.

As can best be understood in FIGS. 2, 6 and 7, when the support arm 20 and spray diffuser 22 are in the vertical, inoperative position, the locking end 80 of the plunger 64 is received within the second locking hole 108 formed in the support arm 20. Since the bias force exertion member 68 exerts an outward force to hold the plunger 64 in its extended position, the plunger 64 is received within the second locking hole 108 and secures the support arm 20 in its inoperative position.

If it is desired to move the support arm 20 and spray diffuser 22 into the horizontal, operative position, the pond aerator must first be turned off to eliminate the water fountain 16. Once the pond aerator has been turned off, the plunger 64 must be moved from its extended position to its retracted position against the bias force exerted by the bias force exertion member 68. In the first embodiment of the invention shown in FIGS. 3 and 4, an outward force is applied to the pull cord 86 to overcome the bias force exerted by the coil spring 70. In the second embodiment of the invention shown in FIGS. 5 and 6, electricity is supplied to the solenoid 90 to pull the plunger 64 into the retracted position Once the plunger 64 has been moved to the retracted position, the weight of the spray diffuser 22 causes the support arm 20 to rotate downward such that the support arm 20 moves into the operative position, as shown in phantom in FIG. 2.

As the support arm 20 moves from the inoperative position to the operative position, the plunger 64 passes through the arcuate plunger groove 110 formed in the first face surface 112 of the support arm 20. Once the support arm 20 reaches the operative position, as shown in FIG. 6, the plunger 64 is released such that the locking end 80 is received within the first locking hole 106, as shown in FIG. 7. The first locking hole 106 secures the support arm 20 in the operative position, as shown in FIG. 6, against the upward force of the water in the fountain 16. In this manner, locking mechanism 24 can be used to securely retain the support arm 20 and spray diffuser 22 in both the operative position and the inoperative position.

As previously discussed, the force of gravity moves the support arm 20 and spray diffuser 22 from the vertical, inoperative position to the horizontal, operative position. If the user desires to move the spray arm 20 from the operative position to the inoperative position, the user first moves the plunger 64 into its retracted position. Once the plunger 64 is in the retracted position, the upward force of the water in the water fountain 16 contacts the spray diffuser 22 and causes the support arm 20 and spray diffuser 22 to rotate upward from the horizontal, operative position to the vertical, inoperative position. Once the support arm 20 is in the inoperative position, the plunger 64 is released such that the locking end 80 is received within the second locking hole 108 formed in the support arm 20.

In the preferred embodiment of the invention, it is contemplated that the solenoid 90 could be operated from the shore of the pond via remote control or hard-wired to the edge of the pond. Further, it is contemplated by the inventors that an anemometer could be coupled to the solenoid 90 to automatically move the spray diffuser 22 to the operative position when the wind speed exceeds a preset limit. In either case, the supply of electricity to the solenoid 90 will result in energization of the solenoid 90 and movement of the plunger 64 from the extended position to the retracted position. In this manner, the solenoid 90 will only draw power when it is desired to move the support arm 20 and spray diffuser 22 between the operative and inoperative positions.

Various alternatives and embodiments are contemplated as being within the scope of the following claims particularly pointing out and distinctly claiming the subject matter regarded as the invention.

What is claimed is:

1. A spray modifier for use in combination with a pond aerator that pumps a fountain of water out of an outlet opening, the spray modifier comprising:

a support arm movable between an operative position and an inoperative position, the support arm extending between a first end and a second end, wherein the force of gravity moves the support arm from the inoperative position to the operative position and the force of the fountain of water moves the support arm from the operative position to the inoperative position;

a spray diffuser mounted to the first end of the support arm, wherein the spray diffuser is aligned with the outlet opening of the pond aerator when the support arm is in the operative position; and a locking mechanism positioned to retain the support arm in the operative position against the force of the fountain of water and to retain the support arm in the inoperative position against the force of gravity, the locking mechanism being selectively activated to permit movement of the support arm between the operative position and the inoperative position.

2. The spray modifier of claim 1 wherein the spray diffuser has a frustoconical shape.

3. The spray modifier of claim 1 wherein the support arm is pivotally mounted between a pair of spaced brackets and the locking mechanism is mounted to one of the brackets.

4. The spray modifier of claim 1 wherein the support arm is generally vertical in the inoperative position and generally horizontal in the operative position.

5. A spray modifier for use in combination with a pond aerator that pumps a fountain of water out of an outlet opening, the spray modifier comprising:

a support arm movable between an operative position and an inoperative position, the support arm extending between a first end and a second end;

a spray diffuser mounted to the first end of the support arm, wherein the spray diffuser is aligned with the outlet opening of the pond aerator when the support arm is in the operative position; and a locking mechanism positioned to retain the support arm in both the operative position and the inoperative position, the locking mechanism being selectively activated to permit movement of the support arm between the operative position and the inoperative position;

wherein the locking mechanism includes a plunger movable between an extended position and a retracted position, the locking mechanism permitting movement of the support arm between the operative position and the inoperative position only when the plunger is in the retracted position.

6. The spray modifier of claim 5 wherein the locking mechanism includes a bias force exertion member that exerts a bias force on the plunger to urge the plunger into its extended position.

7. The spray modifier of claim 6 wherein the bias force exertion member includes a bias spring positioned to exert the bias force on the plunger to urge the plunger into the extended position.

8. The spray modifier of claim 7 further comprising a pull cord attached to the plunger such that an outward force applied to the pull cord overcomes the bias force exerted by the bias spring and moves the plunger from the extended position to the retracted position.

9. The spray modifier of claim 6 wherein the bias force exertion member is an electric solenoid.

10. The spray modifier of claim 9 wherein the electric solenoid is energizable to move the plunger from the extended position to the retracted position.

11. The spray modifier of claim 5 wherein the second end of the support arm includes a first locking hole and a second locking hole spaced from the first locking hole, the first and second locking holes positioned to receive the plunger of the locking mechanism when the plunger is in the extended position.

12. The spray modifier of claim 11 wherein the first locking hole is positioned to receive the extended plunger to secure the support arm in the operative position and the second locking hole is positioned to receive the extended plunger to secure the support arm in the inoperative position.

13. The spray modifier of claim 12 further comprising an arcuate groove formed in the second end of the support arm and extending between the first locking hole and the second locking hole to permit movement of the plunger between the first locking hole and the second locking hole.

14. A spray modifier for use in combination with a pond aerator that pumps a fountain of water out of an outlet opening, the spray modifier comprising:

a support arm movable between a generally horizontal operative position and a generally vertical inoperative position, the support arm extending between a first end and a second end, wherein the weight of the spray diffuser moves the support arm from the inoperative position to the operative position and the upward force of the fountain of water moves the support arm from the operative position to the inoperative position;

a spray diffuser mounted to the first end of the support arm, wherein the spray diffuser is aligned with the outlet opening of the pond aerator when the support arm is in the operative position; and a locking mechanism positioned to retain the support arm in both the operative position and the inoperative position, the locking mechanism being selectively activated to permit movement of the support arm between the operative position and the inoperative position.

15. A spray modifier for use in combination with a pond aerator that pumps a fountain of water out of an outlet opening, the spray modifier comprising:

a support arm movable between an operative position and an inoperative position, the support arm extending between a first end and a second end;

a spray diffuser mounted to the first end of the support arm, the spray diffuser being generally aligned with the outlet opening of the pond aerator to modify the shape of the fountain of water when the support arm is in the operative position; and a locking mechanism positioned adjacent to the support arm, the locking mechanism including a plunger selectively movable between an extended position and a retracted position, wherein when the plunger is in the extended position, the plunger retains the support arm in the operative position and the inoperative position and when the plunger is in the retracted position, the support arm can be moved between the operative position and the inoperative position.

16. The spray modifier of claim 15 wherein the locking mechanism includes a bias force exertion member that exerts a bias force on the plunger to urge the plunger into its extended position.

17. The spray modifier of claim 16 wherein the bias force exertion member includes a bias spring positioned to exert a bias force on the plunger and urge the plunger into the extended position.

18. The spray modifier of claim 17 further comprising a pull cord attached to the plunger such that an outward force applied to the pull cord overcomes the spring bias force and moves the plunger from the extended position to the retracted position.

19. The spray modifier of claim 17 wherein the second end of the support arm includes both a first locking hole and a second locking hole spaced from the first locking hole, the first and second locking holes positioned to receive the plunger of the locking mechanism when the plunger is in the extended position.

20. The spray modifier of claim 19 wherein the first locking hole is positioned to receive the extended plunger to secure the support arm in the operative position and the second locking hole is positioned to receive the extended plunger and secure the support arm in the inoperative position.

21. The spray modifier of claim 20 further comprising an arcuate groove recessed from a face surface of the support arm and extending between the first locking hole and the second locking hole.

22. The spray modifier of claim 16 wherein the bias force exertion member is an electric solenoid operable to move the plunger between the extended position and the retracted position.

23. The spray modifier of claim 22 wherein when the electric solenoid is de-energized, the plunger is in the extended position and when the solenoid is energized, the plunger is in the retracted position.

24. The spray modifier of claim 22 wherein the second end of the support arm includes both a first locking hole and a second locking hole spaced from the first locking hole, the first and second locking holes positioned to receive the plunger of the locking mechanism when the plunger is in the extended position.

25. The spray modifier of claim 24 wherein the first locking hole is positioned to receive the extended plunger to secure the support arm in the operative position and the second locking hole is positioned to receive the extended plunger and secure the support arm in the inoperative position.

26. The spray modifier of claim 25 further comprising an arcuate groove recessed from a face surface of the support arm and extending between the first locking hole and the second locking hole.

27. The spray modifier of claim 15 wherein the spray diffuser has a frustoconical shape.

* * * * *